US011385025B2

(12) United States Patent
Choiniere et al.

(10) Patent No.: US 11,385,025 B2
(45) Date of Patent: Jul. 12, 2022

(54) SWARM NAVIGATION USING FOLLOW THE FORWARD APPROACH

(71) Applicant: BAE SYSTEMS Information and Electronic Systems Integration Inc., Nashua, NH (US)

(72) Inventors: Michael J. Choiniere, Merrimack, NH (US); Matthew F. Chrobak, Groton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 356 days.

(21) Appl. No.: 16/718,889

(22) Filed: Dec. 18, 2019

(65) Prior Publication Data

US 2021/0190459 A1 Jun. 24, 2021

(51) Int. Cl.

| | |
|---|---|
| ***F41G 7/30*** | (2006.01) |
| ***F41G 9/00*** | (2006.01) |
| ***F41G 7/00*** | (2006.01) |
| ***F42B 12/36*** | (2006.01) |
| ***F41G 7/22*** | (2006.01) |

(52) U.S. Cl.

CPC ..... *F41G 7/308* (2013.01); *F41G 7/008* (2013.01); *F41G 7/2233* (2013.01); *F41G 7/303* (2013.01); *F41G 9/00* (2013.01); *F42B 12/365* (2013.01)

(58) Field of Classification Search

CPC ..... F41G 7/308; F41G 7/008; F41G 7/2233; F41G 7/303; F41G 9/00; F41B 12/365

See application file for complete search history.

(56) References Cited

U.S. PATENT DOCUMENTS 5,601,255 A * 2/1997 Romer ..... F41G 7/263 244/3.13
8,748,787 B2 * 6/2014 Weiss ..... F41G 3/04 244/3.13

(Continued)

FOREIGN PATENT DOCUMENTS

WO 2006/091240 A2 8/2006
WO 2019/132758 A1 7/2019

OTHER PUBLICATIONS

Chen et al., "A Target Identification Method for the Millimeter Wave Seeker via Correlation Matching and Beam Pointing", MPDI, Jun. 2019, retrieved on [Aug. 27, 2021). Retrieved from the internet <URL: https://www.mdpi.com/1424-8220/19/11/2530/htm> entire document.

(Continued)

*Primary Examiner* — Marcus E Windrich
(74) *Attorney, Agent, or Firm* — KPIP Law, PLLC; Gary McFaline

(57) ABSTRACT

The system and method of swarm navigation using a follow the forward approach. Using on-board sensors and communications links between members of a swarm, numerous targets can be engaged more quickly and precisely. In some cases, a designator is used to help a forward of the swarm navigate to a target using image-based navigation up until terminal guidance is used. A cascade of messages are projected back to a following round so that, each member of a swarm can determine a best target/round match and provide real-time, up-to-date information regarding targets' locations and each round's location, range to target, target selection, and the like.

19 Claims, 8 Drawing Sheets

(56) References Cited

U.S. PATENT DOCUMENTS

| | | | | |
|---|---|---|---|---|
| 8,833,231 | B1 | 9/2014 | Venema | |
| 9,683,814 | B2 * | 6/2017 | Dryer | F41G 7/30 |
| 10,012,477 | B1 * | 7/2018 | Ell | F41G 7/2253 |
| 2006/0238403 | A1 | 10/2006 | Golan et al. | |
| 2008/0206718 | A1 | 8/2008 | Jaklitsch et al. | |
| 2013/0153707 | A1 * | 6/2013 | Gate | F41G 7/22 244/3.15 |
| 2014/0251123 | A1 | 9/2014 | Venema et al. | |
| 2017/0314892 | A1 | 11/2017 | Holder | |
| 2018/0209764 | A1 * | 7/2018 | Ginsberg | F41G 7/226 |
| 2019/0294182 | A1 | 9/2019 | Durand et al. | |

OTHER PUBLICATIONS

International Search Report, PCT/US20/65093, dated Sep. 28, 2021, 9 pages.

* cited by examiner

SWARM NAVIGATION USING FOLLOW THE FORWARD APPROACH

FIELD OF THE DISCLOSURE

The present disclosure relates to directed navigation of munitions and more particularly to using a follow the forward approach to track and navigate members of a swarm.

BACKGROUND OF THE DISCLOSURE

Current round or munitions deployed at targets have limited weight and space allocations for imagers, which reduces their ability to locate and identify targets to only 1 to 2 Km. Given these rounds are launched at targets from 3 to 20 Km away, the current seekers are insufficient to navigate to the target. When using a designator as a means for in-flight navigation, current systems typically designate a target for the entire flight for a single round. This approach is very time consuming and results in rounds potentially firing every minute sequentially. If the targeting platform needs to fire 10 rounds for the engagement, it may take 10 minutes to fire the $10^{th}$ round. In a swarm boat situation, for example, it is preferred to fire 5 to 20 rounds is less than a minute in a rapid-fire sequence or at about 3 second intervals.

Recent technology developments utilize an imager with see-spot capability to determine a target selection of a forward munition. The targeting method matches a target in an image frame with a see-spot generated by the forward munition's optical beacon. A lagging munition will then determine the forward munition's target selection based on the target dispersion relative to the forward munition's trajectory in the scene. A fundamental limitation to determining target selection for conventional systems is that the lagging imager's target detection requires the prior presence of the beacon for the method to be effective; thereby greatly reducing the range to near the target (~1 to 2 Km).

Wherefore it is an object of the present disclosure to overcome the above-mentioned shortcomings and drawbacks associated with conventional multiple object tracking and navigation.

SUMMARY OF THE DISCLOSURE

One aspect of the present disclosure is a system for swarm navigation using a follow the forward approach, comprising: a plurality of rounds, wherein the plurality of rounds comprise: a semi-active laser (SAL) seeker per round configured to: provide an angular bearing of a designator spot location within a target area; provide angular bearings for any forward rounds; and provide an optical communications link via a receiver; an imager configured to: locate and identify a plurality of targets in the target area; or provide image-based navigation when correlated with the designator spot location; and an on-board processor per round configured to: decode optical messaging from the communications link; correlate the designator laser spot with imagery captured by the imager; generate a target data set; select a target from any currently un-selected targets within the target data set; plot a trajectory for navigation to the selected target using any forward rounds as an airborne constellation; and broadcast, via the optical communications link, the target data set, one or more data sets from forward rounds, and a "self-data" set in order to sustain a cascade effect.

This method's core advantage over the previous art is that it does not require the lagging imagers to locate the targets with the corresponding beacons for the forward munition in order to select a target, plot, and execute its navigation solution. The application method herein correlates a forward munition's target selection (after being guided to the target set by a designator) with its trajectory, along with a target set data description comprising data relating to one or more targets which is then communicated to the one or more lagging munitions. At that time, the lagging munitions will not have detected the target set (e.g., they are lagging by >0.5 km from the detection range). By using the communicated target data, the range to targets, and the location of the one or more forward rounds, the one or more legging munitions can generate a navigation solution using the one or more forward munitions as navigation reference(s) and alter their respective course left or right based on the "range to go" to any newly selected targets and the cross range distance of the reference beacon. The cross range distance relates to the precision to which the target's location is known.

One embodiment of the system for swarm navigation using a follow the forward approach is wherein the imagers can be visible, near-infrared (TOR), short wave infrared (SWIR), mid-wave infrared (MWIR) or long-wave infrared (LWIR). In some cases, the communications link can be visible, NIR, SWIR, MWIR or LWIR.

Another embodiment of the system for swarm navigation using a follow the forward approach is wherein the SAL seeker and the communications link are of different bands whereas the SAL is one band and the communications link is another requiring a second receiver tor the communications link.

Yet another embodiment of the system for swarm navigation using a follow the forward approach further comprises an altimeter to provide altitude to aid in navigation of the round.

Another aspect of the present disclosure is a method for swarm navigation using a follow the forward approach, comprising: guiding, via a laser designator, a forward round in a plurality of rounds launched from a launch platform toward a target area; wherein each round comprises: a semi-active laser (SAL) seeker, wherein the seeker is configured to provide angular bearing of a designator spot location within a target area: provide angular bearings for any forward rounds; and provide an optical communications link via a receiver function; an imager, wherein the imager is configured to provide an Automatic Target Recognition (ATR) function for locating and identifying a plurality of targets in the target area; or provide image-based navigation when correlated with the designator spot location; and an on-board processor, wherein the on-board processor is configured to decode optical messaging from the communications link; correlate the designator laser spot with imagery captured by the imager; generate a target data set; select a target from any currently un-selected targets within the target data set; plot a trajectory for navigation to the selected target using any forward rounds as an airborne constellation; and broadcast, via the optical communications link, the target data set, one or more data sets from forward rounds, and a "self data" set in order to sustain a cascade effect; determining a horizon for providing roll stability and finding up and down using the imager; detecting via the forward round's imager a target set when she target set is within a FOV of the imager; characterizing the target set, the target set data comprising dispersion geometry for a plurality of targets, a target count, and target IDs; determining velocity and headings for the plurality of rounds relative to a launch vector; estimating a range to target for each of the plurality of targets from the launch platform; selecting a target from un-selected targets in the target sot based its range to go, its control authority for the list of un-selected targets; generating a navigation solution for the round using scene data from the imager, and broadcasting an updated target data set via an optical link to any following rounds.

One embodiment of the method for swarm navigation using a follow the forward approach is wherein designation of a target is an actual target or a terrain reference.

Another embodiment of the method for swarm navigation using a follow the forward approach is wherein the communications link is a pulse repetition interval (PRI) modulated code or standard binary code.

In some cases, the seeker and the optical communications link receiver are the same device or decoupled into separate components.

In yet another embodiment, a cascade for information is received by the launch platform to establish a quality metric for a target attack.

Still yet another aspect of the present disclosure is a plurality of rounds configured to operate using a follow the forward approach, the rounds comprising: a forward looking seeker configured to process designator reflections of a target if the round is a leading round: a forward facing imager configured to process image scenes of a target area proximate the target if the round is the leading round; a processing section for determining attributes of the target and one or more additional targets in the target area; and a rearward facing laser for communicating the attributes to subsequent rounds to provide for operation as a constellation.

In one embodiment of the plurality of rounds, the imagers can be visible (VIS), near infrared (NIR), short wave infrared (SWJR), mid wave infrared (MWIR), or long wave infrared (LWIR). In one embodiment of the plurality of rounds, a communications link for communicating can be visible (VIS), near infrared (NIR), short wave infrared (SWIR), mid wave infrared (MWIR), or long wave infrared (LWIR). In some cases, the SAL seeker and the communications link are of different wavelength ranges whereas the SAL is one wavelength range and the communications link is another requiring a second receiver for the communications link. In certain embodiments, the seeker and the communications link receiver are the same device or decoupled into separate components.

Another embodiment of the plurality of rounds is wherein designation of a target is an actual target or a terrain reference. In some cases, the communications link is a pulse repetition interval (PRI) modulated code or standard binary code.

Yet another embodiment of the plurality of rounds is wherein a cascade of information is received by the launch platform to establish a quality metric for a target attack. In some cases, the plurality of rounds further comprise an altimeter to provide altitude to aid in navigation of the round.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1:
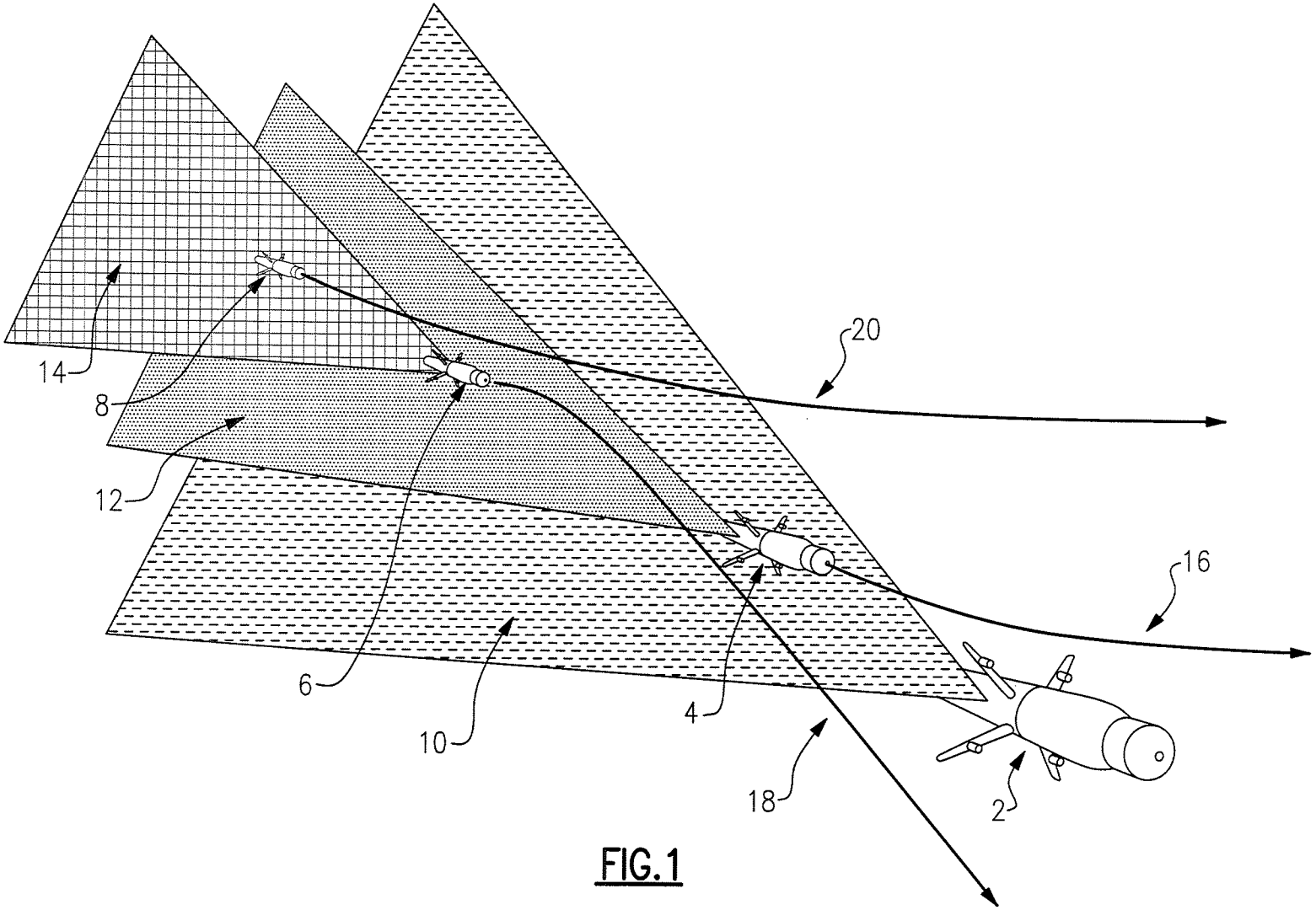
FIG. 1 is a diagram of one embodiment of swarm navigation using a follow the forward approach according to the principles of the present disclosure.

One aspect of the present disclosure is a system comprising u plurality of rounds fired in a controlled sequence (rounds, missiles, guided rockets, free fall munitions, glide bombs, artillery, or the like) that act in concert or as an airborne constellation. A constellation in this context being a group of rounds working together as a system. Unlike a single round, a constellation can provide greater coverage than the sum of the individual rounds. These rounds navigate to a plurality of targets using a forward most round's position relative to a target array. The forward most round is guided by a laser designator to engage a specific target within the target array. As the forward most round approaches the target array (multiple targets in a formation), an imager (LWIR, NIR, Visible. SWIR or MWIR) is used by the forward most round to characterize the array in terms of number of targets, relative position of each target to each other, classification/ID of the multiple targets, estimated target and forward most round range from the launch platform. In certain embodiments, the forward most round communicates this information back to the plurality of lagging munitions.

Certain embodiments of the system of the present disclosure comprise communications links (e.g., a 1 to 5 Hz rate) comprised of a coded laser/optical transmissions to provide all data gathered from a forward round to allow a next round in the sequence to determine which target it should select based on its range to target and control authority to ensure a high probability of hit. As the information is cascaded to each successive round, the transmitting round adds its target selection and its current location and altitude relative to the target formation (or its "self-data") allowing the following rounds to only engage unselected targets.

A feature of the optical communications is that each round has a seeker, which can locates 1 to N rounds in its forward field of view (FOV). In one example the seeker is a semi-active laser (SAL) seeker. By having information from the forward round's trajectory and position within the trajectory, based on their target selections and coded communication messages, the ability of etch round to navigate to a target is possible such as using an ad hoc, round constellation approach. In one example each forward round provides information to the subsequent round. In a further example, a forward round provides information to oik or more subsequent rounds. The subsequent rounds can leverage the information to confirm and adjust to the initially selected target or change to an unselected target.

According to one example, once the imager of the forward round acquires the target array, the use of a designator is no longer necessary and the plurality of rounds form a navigation network stretching from the launch platform to the target area. In one embodiment, the rounds engage a land based threat. In this embodiment, the designator points to a ground position in the center of the target array. An imager on the round working with the seeker detects the laser return and correlates it to oik or more pixels in the scene captured by the imager. That correlation allows the forward round to navigate to the ground position anointed by the laser using terrain navigation. To detect the plurality of targets, the round needs to be considerably closer to the target set given its limited optics. Once the target array has been detected, as described above, the forward round characterizes the engagement and provides the following rounds the necessary information for target selection and navigation to respective targets. This allows the designator to target another location with another set of rounds.

Referring to FIG. 1, a diagram of one embodiment of swarm navigation using a follow the forward approach according to the principles of the present disclosure is shown. More specifically, as used herein c moving object that is part of a swarm may be a round, guided munition or an unmanned aircraft system (UAS). As used herein, a round may be a round, a projectile, a ballistic, a bullet, a munition, a guided round, or the like. In certain embodiments, a guidance kit, such as a mid-body guidance kit on a round secs the location of previous rounds using a semi-active laser seeker, a communication link, and the like. For each member (e.g., round) the location is known, both range and location to target, as part of the follow the forward approach described herein. In one example the rounds can be branched serially with a slight delay between each round such that the first round is the forward round. If there are more rounds than targets, the subsequent rounds can follow the prior round. The round in one example uses a forward looking seeker to identify a target such as by a laser designator reflection off the target. In a further example the round can use a forward facing imager to capture a scene of a target area that contains the one or more targets, the rounds can employ a rear facing communications link such as from a diode to provide information to subsequent rounds.

A first round, or forward round 2, starts the volley with designation of the one or more targets in this example. A second round 4 can use the designator information and other information 10 from the first round 2. Here, the second round 4 will adopt a trajectory 16 so that an efficient mission cat be accomplished. A third round 6 uses the designator information and other information 12, 10 from the second round 4 and the first round 2 to determine its trajectory 18 according to the still available one or more targets. This continues on to a fourth round 8 using the information 14, 12, 10 from the preceding rounds 2, 4, 6 to determine a trajectory 20 to effectively accomplish the mission. A final round follows the others to the target area. The designator in this example can cease at the end of the firing and transition to another target. In some cases, this allows for rapid firing of several rounds and using the communications link and location information can more effectively engage multiple targets such that lime can be saved having each select an optimal target. In one example, and optimal target might be for a later fired round to turn and head towards a further target that has more time to go, requiring less control authority to reach the target while an earlier fired target could pick a more proximal target since it has depleted dispersion/control authority in comparison.

Figure 2:
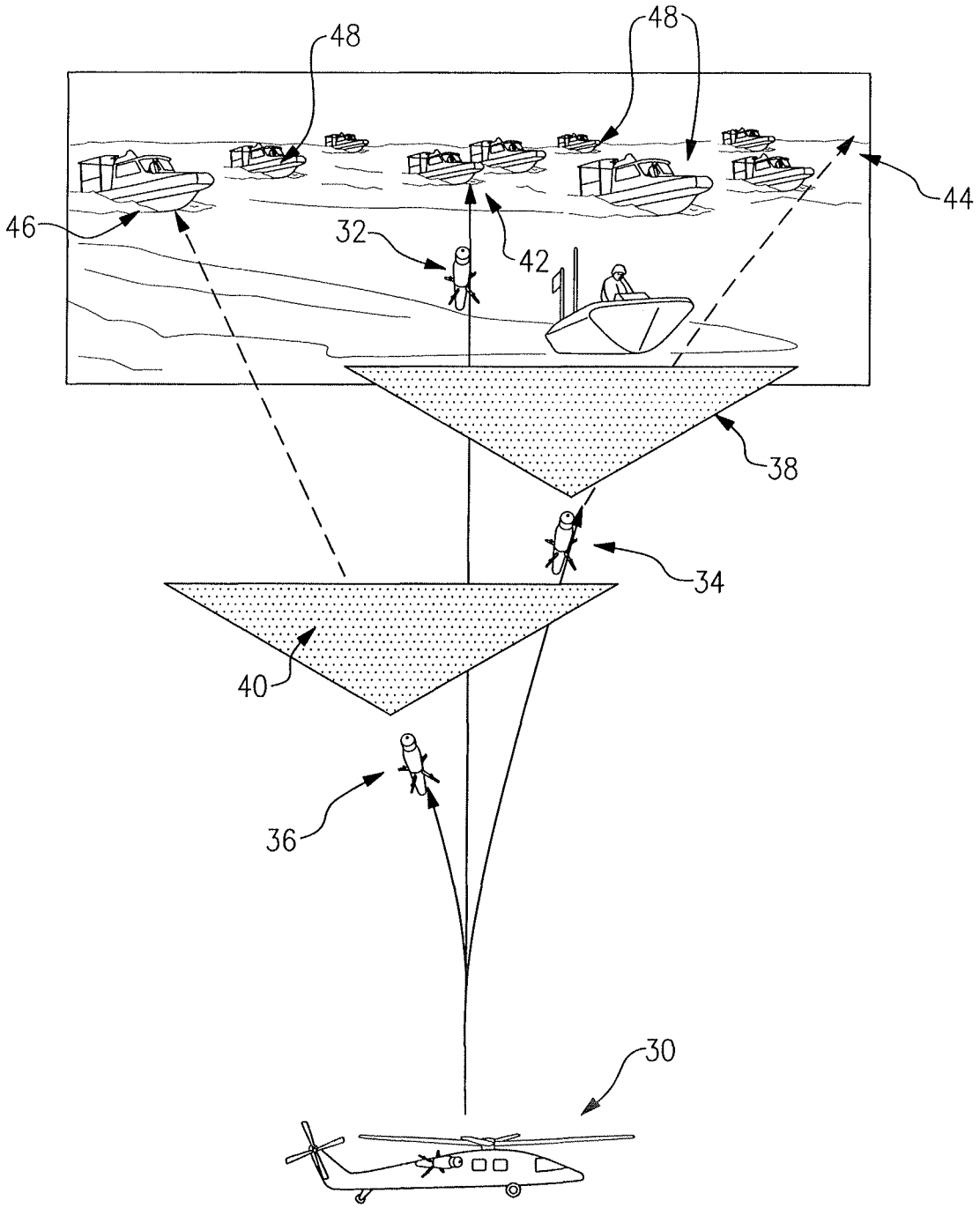
FIG. 2 is a diagram of one embodiment of swam navigation using a follow the forward approach according to the principles of the present disclosure.

Referring to FIG. 2, a diagram of one embodiment of swarm navigation using a follow the forward approach according to the principles of the present disclosure is shown. More specifically, one embodiment of the system 30 of the present disclosure has the ability to launch a canister of rounds (e.g., 10 rounds) using a singular designated target while engaging all approaching fast attack boats 48, for example. In this embodiment, a designator is used to guide a lead round 32 to the target area such as at a center mass of the incoming boats 42. A communications link, such as electro-optical (EO)/Infrared (IR) communication from the preceding round 32 allows a seeker on the following round 34 to obtain information 38 of the current flight path from the previous rounds 32. Likewise, the communications link from the preceding rounds 32, 34 and a seeker on the following round 36 to obtain information 38, 40 of the current (light paths from the previous rounds 32, 36. By knowing their respective range to target and their position relative to the targets and targets' location (via a cascade of communications to the rounds in the rear) the swarm (32, 34, 36, collectively) can use the signal Az/El information as an inflict constellation to guide the plurality of rounds (32, 34, 36) to the targets (44, 46, 48).

Typical systems require 45 to 60 seconds per round launch for a total of 1140 seconds (for 19 rounds). In contrast, the present disclosure provides for emptying a canister (of 19 rounds) in a single pass in <100 seconds. In one embodiment, it takes about 40 seconds to aim the first round, and each of the remaining 19 units are launched in 3 second intervals thereafter. The delay time between subsequent rounds can be increased or decreased depending upon the engagement plan and targets.

Figure 3:
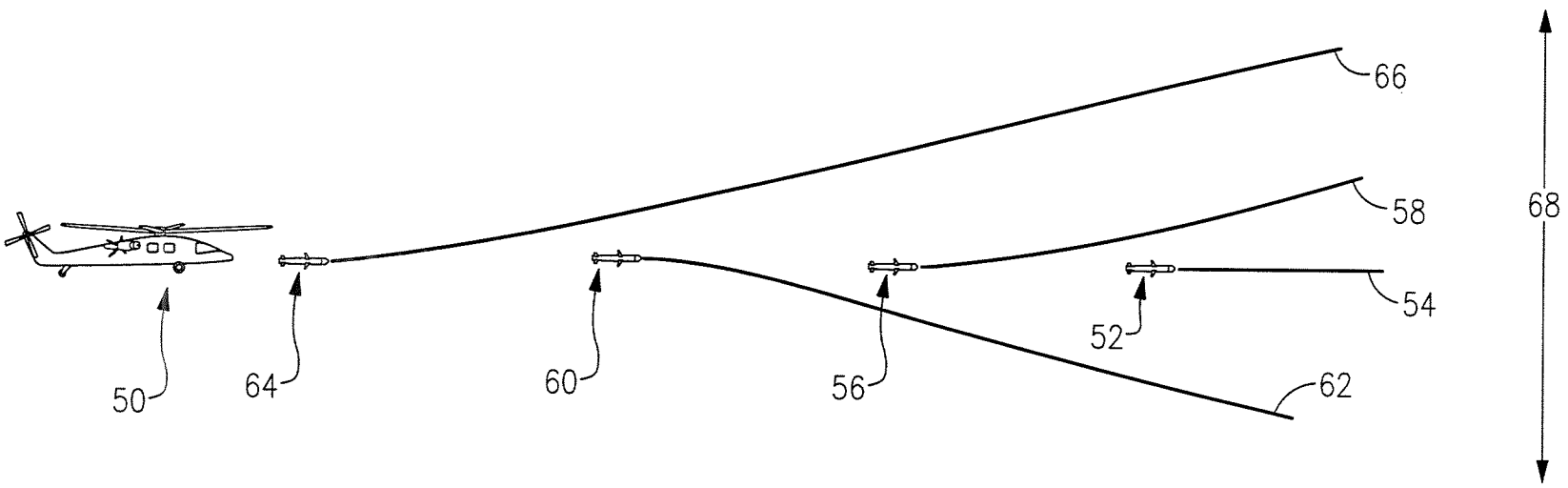
FIG. 3 is a diagram of one embodiment of swarm navigation using a follow the forward approach according to the principles of the present disclosure.

Referring to FIG. 3, a diagram of one embodiment of swarm navigation using a follow the forward approach according to the principles of the present disclosure is shown. More specifically, a lead round 54 is launched from a platform 50 and that lead round 54 acts as a scout and reports several pieces of information to the remaining members of the swarm 56, 60, 64. In one embodiment, the information reported by the forward round includes the range to a target group, cross range spread 68 or the degree of spread for a target detection (blurring) relating to the range walk and the cross-range resolution far a target having translational velocity, the number of targets, the spacing of targets within the target group, and the like. This information is then used to map trajectories 54, 58, 62, 66 for the members of the swarm 52, 56, 60, 64 to each target in the target group. This includes information such as which target the forward round is engaging, the position of the lead round relative to the group, current altitude, and the like. The information reported by the second member 56 of the swarm includes an echo of the forward's information, the second round's range position relative to the group, which target the second round is engaging, and the like. The subsequent rounds 60, 64 echo the information from the forward round, report the respective range position relative to the group, which target they are engaging, and the like. By knowing the horizon, the altitude, the range of the members ahead and the "time to go" to the target area, each lagging round can select the next target and map a trajectory 54, 58, 62, 66 that allows engagement. In one example, a round may already have a trajectory that will not allow it to reach a certain target and by communicating information to successive rounds, one of the rounds can adjust the flight parameters and change the trajectory so that it can reach the selected target.

Figure 4:
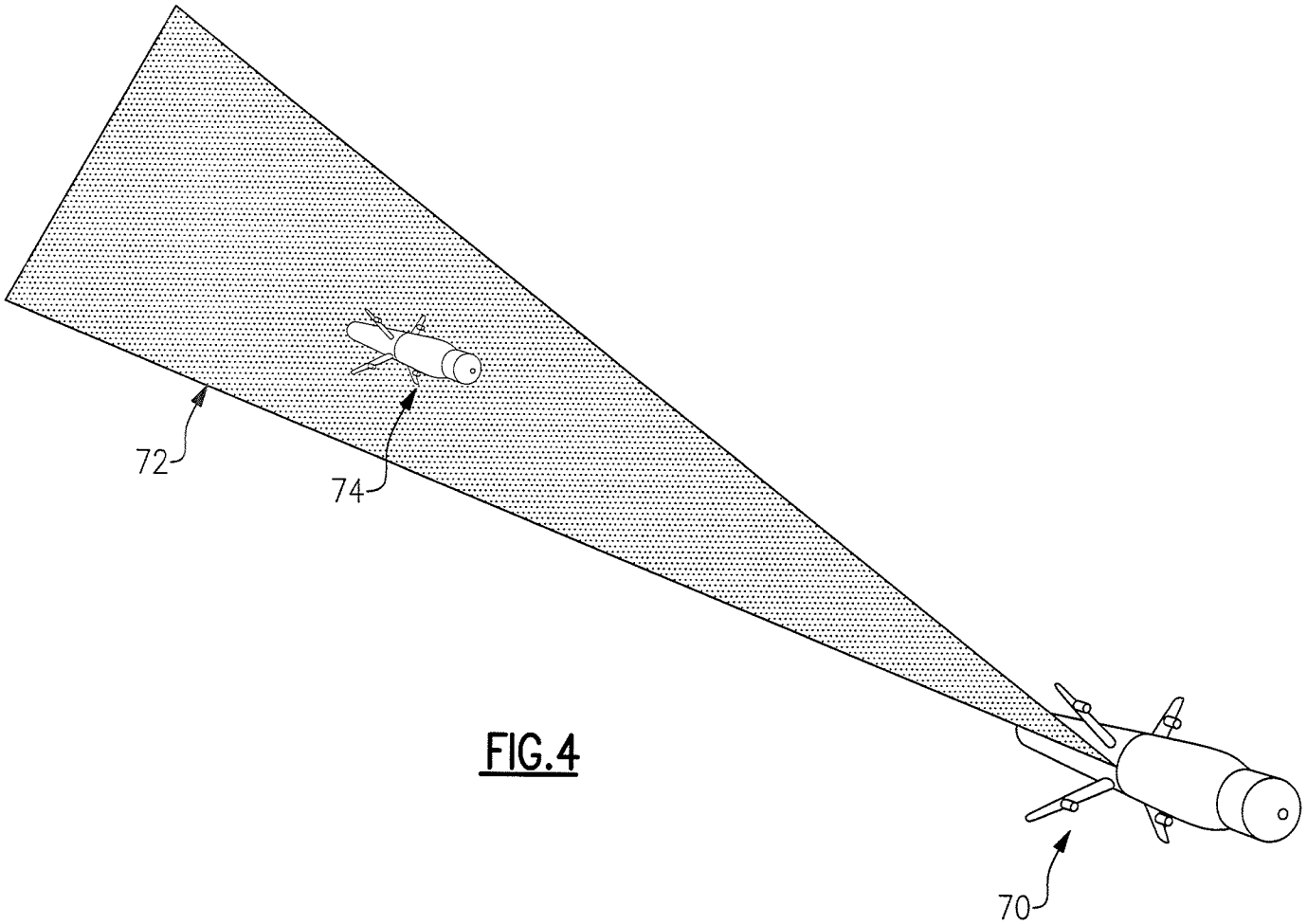
FIG. 4 is a diagram of one embodiment of a communications link used in object tracking according to the principles of the present disclosure.

Referring to FIG. 4, a diagram of one embodiment of swarm navigation using a communication link for object tracking according to the principles of the present disclosure is shown. Mere specifically, one embodiment of the system provides the ability to communicate round to round in a cascade fashion from the forward round to the follower rounds(s) using a SAL seeker as both a designator sensor and a communications link receiver. In this way, several rounds can behave as a constellation.

In one embodiment a round 70 has a high power laser diode (e.g., 1.5 um) that radiates a 20 to 30 degree beam 72 and n following round 74 at around 300 to 600 meters behind can get a bearing of its position and a cascade message from the forward 72. In navigation, bearing is the horizontal angle between the direction of an object (where, a round's heading or track) and another object (another round), or between it and that of true north. The message would contain the flowing information: range to target group, cross range target spread, the number of targets within the group, the spacing of targets within the group, and the like. All of which is used to map trajectories, which target a round is engaging, a position relative to the group, a current altitude, and the like.

Current solutions tend to use RF, which requires an additional RF receiver component. In contrast, the seeker of the present disclosure can provide berth a designation function and a communications receiver function with the added benefit of determination of a direction of arrival of the transmitting round (located in front of a receiving round) thus allowing in flight navigation of the round using a follow the forward approach. In one embodiment, the seeker has a 20° to 30° FOV coverage, a High Power pulsed diode of about 100 watts, a 500 nanosecond pulse, at 5 to 10 KHz. and about a 200 bit message. The seeker can provide the range to target group, cross range spread, the number of targets, the spacing of targets within the group for use in mapping trajectories for the members of the swarm. This allows each to message which target the member is engaging, its position relative to the group, and current altitude, at about a 2 to 5 Hz update rate. The SAL seeker therefore can provide a designator location, a communications link/message and bearing information of the round in front.

Figure 5:
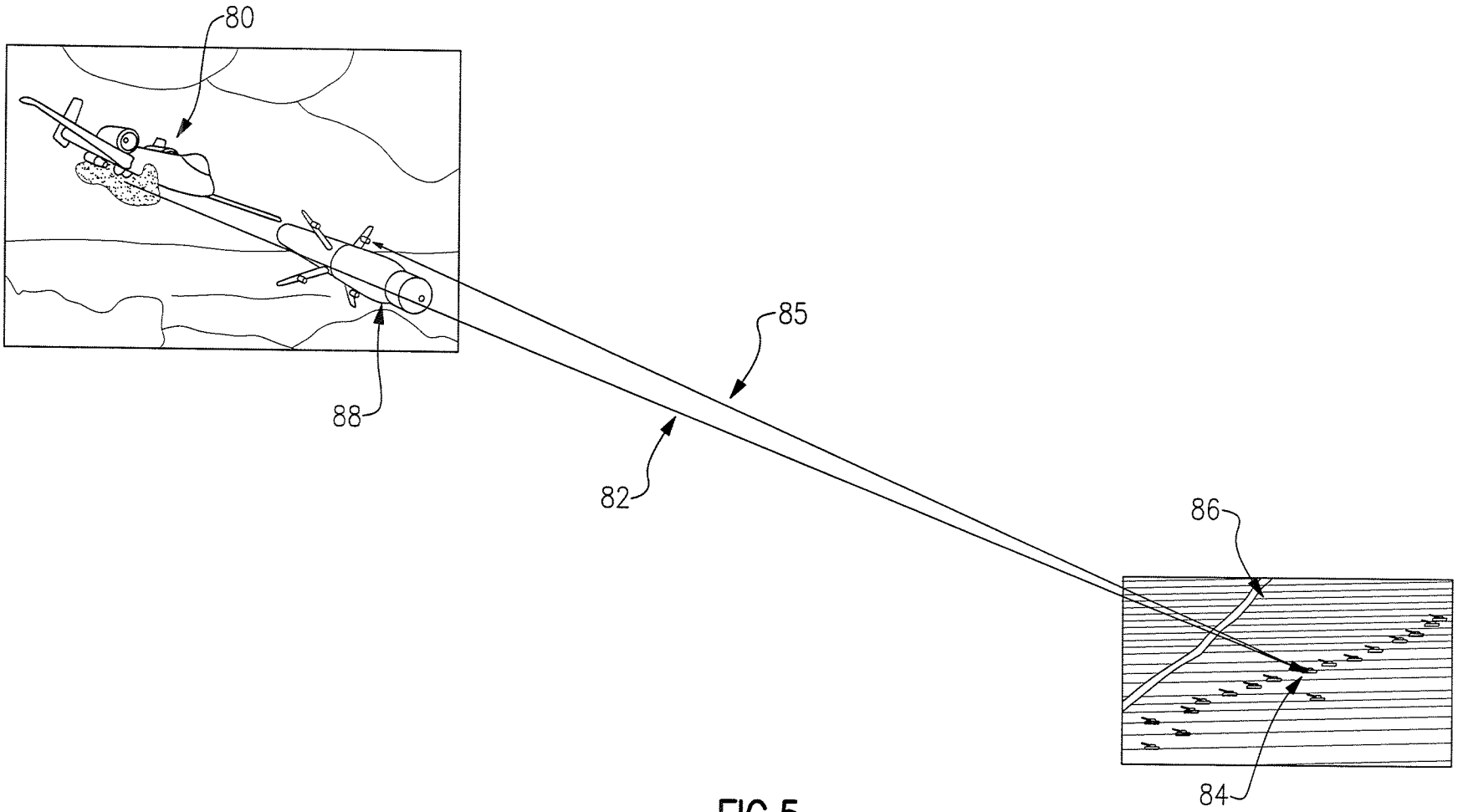
FIG. 5 is a diagram of another embodiment of swarm navigation using a follow the forward approach according to the principles of the present disclosure.

Referring to FIG. 5, a diagram of another embodiment of swarm navigation using a follow the forward approach according to the principles of the present disclosure is shown. More specifically, one embodiment of the system for swarm navigation using a follow the forward approach has the ability to fire a salvo of rounds against several targets at long range. In one embodiment a laser designator on board the aircraft transmits a laser designator signal 82 is used to mark a reference point on the ground 84. The laser designator in other examples can be from other references such as from a ground position or another aircraft. The reference point on the ground 84 in one example is the middle or center of a target area. A designator reflection 85 from the reference point 84 is detected by the forward looking seeker on the round 88 that is able to detect the laser reflection such as by using photo detectors. In addition, using a forward looking sensor, such as LWIR sensor, on the forward round 88, an image of the target area 86 is taken and the designator reference 84 can be transferred to the image sensor and the designator can be turned oil to prevent detection or target other sites. The round 88 is flown using the image-based navigation until the LWIR sensor IDs the target for terminal guidance.

A LWIR sensor with a small aperture can generally only detect to about to 1.5 Km, thereby needing longer periods of designation. Employing the follow forward approach, where the leading round communicates information to the rest of the swarm, only 3 to 4 seconds are required rather than the 20 to 30 seconds of traditional systems. This additional time allows the platform 80 to get out of harm's way much sooner or to identify other targets. This also allows for use of a salvo of several rounds using the follow the forward approach for subsequent launches by anointing the track reference point on the ground, using LWIR imagery for image-based navigation until the sensor detects the target using the anointed reference up until terminal guidance is used. This ability for the platform to break off and then have the attack happen can preserve resources and using follow the forward, multiple rounds can be expended in a single pass saving time.

Figure 6:
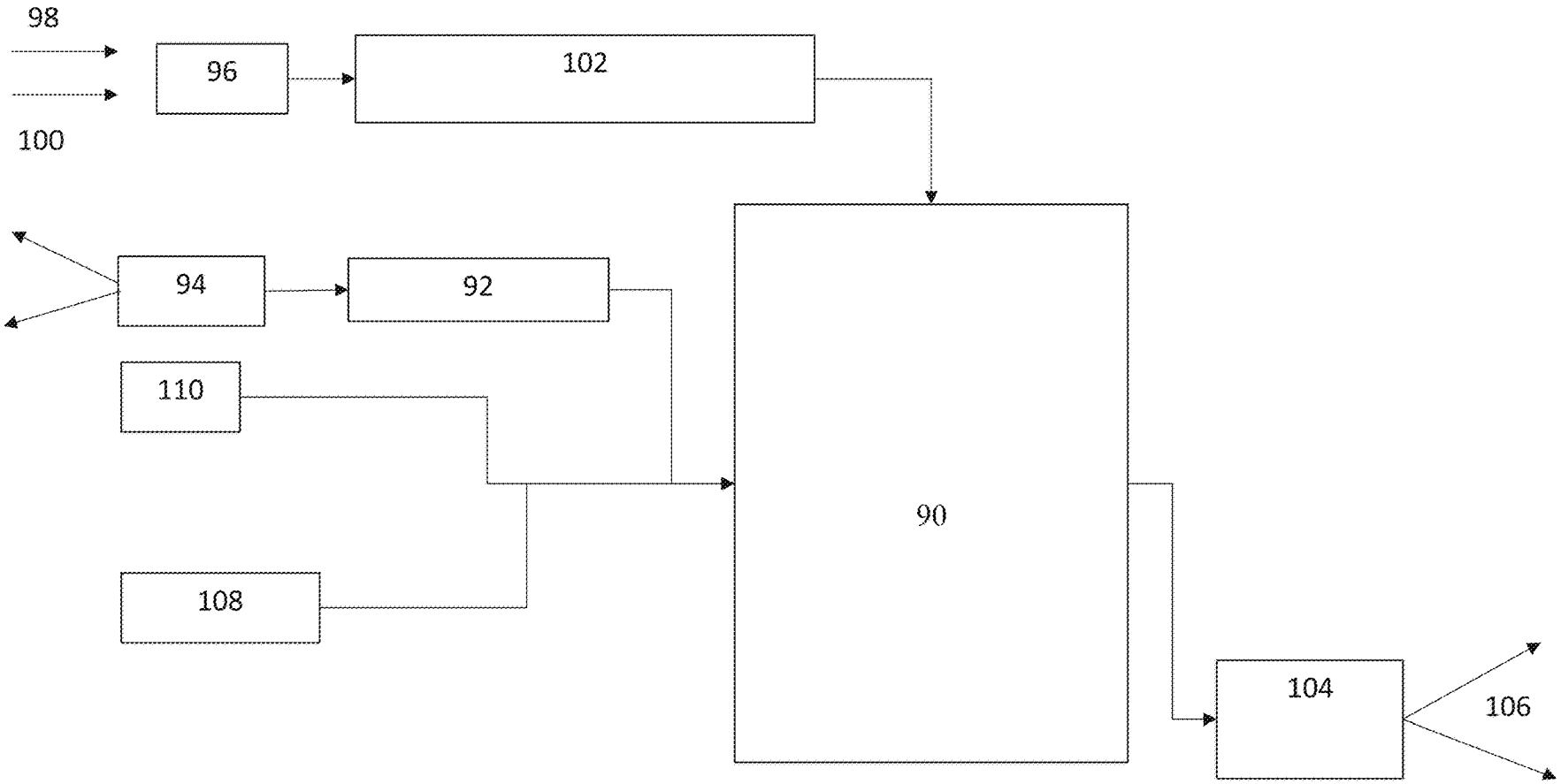
FIG. 6 is a flowchart of one embodiment of method of swarm navigation using a follow the forward approach according to the principles of the present disclosure.

Referring to FIG. 6, a flowchart of one embodiment of a method of swarm navigation using a follow the forward approach according to the principles of the present disclosure is shown. More specifically, a diagram showing how the data is collected, processed, and cascaded to follower rounds. A processor 90 on-board a round performs a variety of functions. The on-board processor correlates a laser spot received via a SAL seeker 96 from a target illuminated by a designator that provides a target reflection 98. In one example, the processor determines a horizon, and up and down from imagery 92 collected by an imager 94. The imager 94 can also capture an image of the scene if the leader round is in range of the imager. If the round is a leader, the round navigates using a designator reflection 98 until the target array is detected. If the round is a leader, it decodes Az/El position. If the round is a follower, the on-board processor generates a navigation trajectory based on the leader(s) position relative to the target array and horizon based on optical data 102 received via the SAL seeker 96 from a communications link 100 from the leader. The processor 90 in one example performs Automatic Target Recognition (ATR), or the like, to locate and identify a plurality of targets and determines the engagement data for the mission, including the number of targets, cross range dispersion, target IDs, etc. The on-board processor 90 selects a target based on the round's control authority and its range to go or time to go to the target, after removing previously selected targets (if the round is a follower) or confirming the previously selected target. Additionally, the on-board processor 90 forms a data packet 106 and broadcasts it via a communication link 104 in order to sustain the cascade by providing data from its perspective (or self) as opposed to data provided by other members of the constellation. In some cases, the on-board processor receives data from additional components, including an altimeter 108 and/or an IMU 110. The communications link 104 in one example is a rear facing high power laser diode (e.g., 1.5 um) that radiates a 20 to 30 degree beam towards the subsequent rounds.

Figures 7A, 7B:
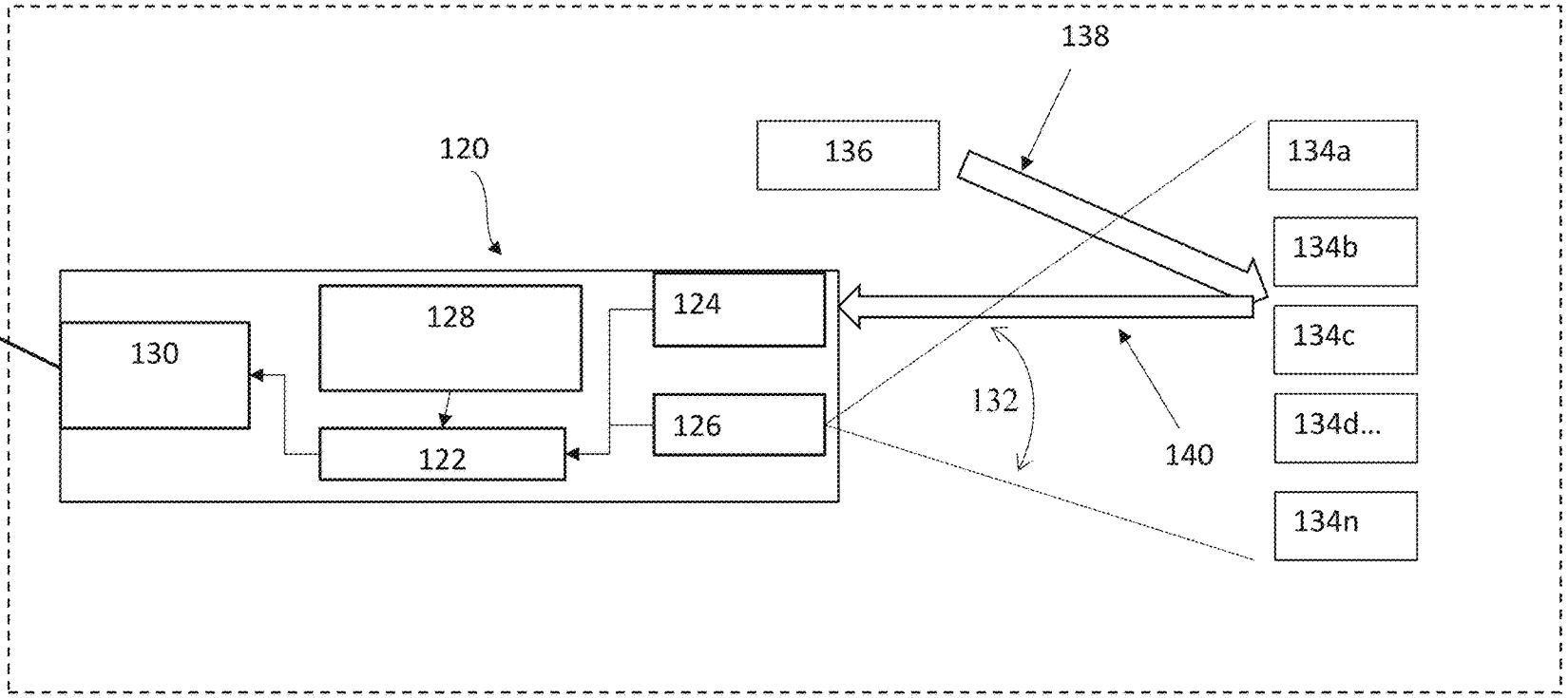
FIG. 7A and FIG. 7B are functional block diagrams of some processing steps illustrating data collection and computed navigation data in a cascade from a forward most round FIG. 7A to a following round FIG. 7B according to the principles of the present disclosure.
Figure 7B:
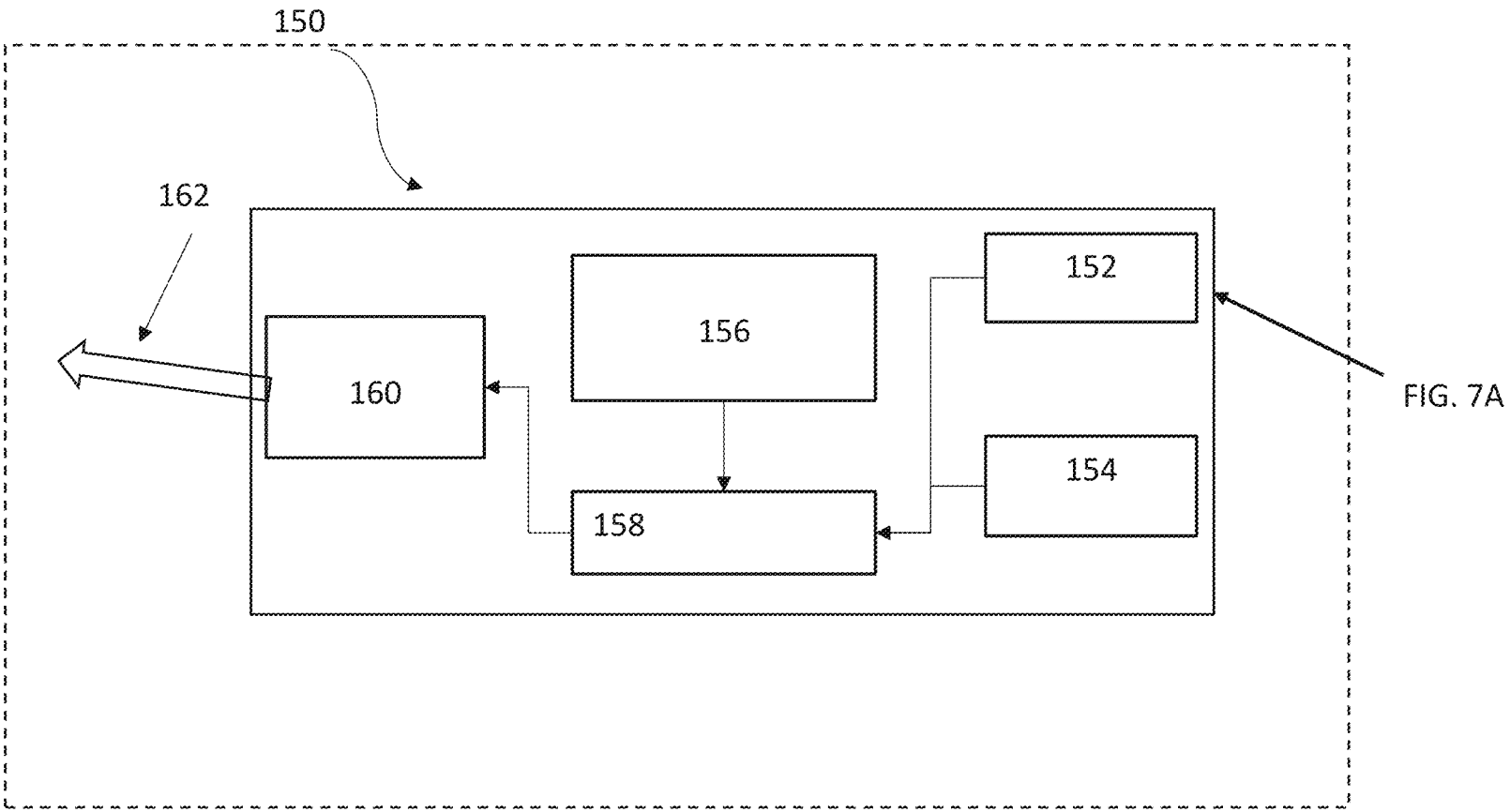

Referring to FIG. 7A and FIG. 7B, functional block diagrams of some processing steps illustrating data collection and computed navigation data in a cascade from a forward most round FIG. 7A to a following round FIG. 7B according to the principles of the present disclosure are shown. More specifically, the block diagrams comprise etch round's sensor suite with the elements/subsystems needed to collect the data and process the data to formulate the communications data packet that is used to communicate between members of the swarms.

Referring to FIG. 7A, the forward round 120 has a processor 122 that correlates the designator reflections from the SAL seeker 124 and scenes captured by the imager 126, where the imager 126 has a FOV 132 and identifies multiple targets 134*a* . . . 134*n* in the FOV. The imager 126, once in range, collects images of the target scene and uses the horizon to determine up and down reference. In some cases, the round has additional components 128 including one or more navigation sensors, IMUs, altimeters, and the like. In some cases, a designator 136 is used to illuminate 138 a target area and that feedback 140 is received by the SAL seeker 124. The processor 122 performs a number of functions, including determines range from the round to the target group, clocked time from launch and estimated time to go to the target group, target array cross range dispersion, the number of targets, the spacing of targets within the group, round trajectories for followers, which target it is engaging, the round's position relative to the group, its current altitude, and the like. This information is transmitted via a communication link 130 such as an optical signal from a laser to a follower round (see. FIG. 7B).

Referring to FIG. 7B, a following round 150 receives data from at least one forward round (see. FIG. 7A) via a SAL seeker 152. The seeker 152 decodes communications message and determines the Az/El of the rounds in its FOV. The follower round 150 also has an imager 154 and additional components 156 much like the leading round. The on-board processor 158 adds its data to the received data to complete the cascade by transmitting data 162 via a communications link 160 to other following rounds and performs all other lead functions as needed.

The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

It will be appreciated from the above that the invention may be implemented as computer software, which may be supplied on a storage medium or via a transmission medium such as a local-area network or a wide-area network, such as the Internet. It is to be further understood that, because some of the constituent system components and method steps depicted in the accompanying Figures can be implemented in software, the actual connections between the systems components for the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims, further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood us requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A system for swarm navigation using a follow the forward approach, comprising:

a plurality of rounds, wherein the plurality of rounds comprise:

a seeker per round configured to provide at least one of:

provide angular bearing of a designator spot location within a target area;

provide angular bearings for any forward rounds; and provide an optical communications link via a receiver;

an imager per round configured to:

locate and identify a plurality of targets in the target area; or provide image-based navigation when correlated with the designator spot location; and an on-board processor per round configured to:

decode optical messaging from the communications link;

correlate the designator laser spot with imagery captured by the imager;

generate a target data set;

select a target from any currently un-selected targets within the target data set;

plot a trajectory for navigation to the selected target using any forward rounds as an airborne constellation; and broadcast, via the optical communications link, the target data set, one or more data sets from forward rounds, and a self-data set in order to sustain a cascade.

2. The system for swarm navigation using a follow the forward approach according to claim 1, wherein the imagers can be visible (VIS), near infrared (NIR), short wave infrared (SWIR), mid wave infrared (MWIR), or long wave infrared (LWIR).

3. The system for swarm navigation using a follow the forward approach according to claim 1, wherein the communications link can be visible (VIS), near infrared (NIR), short wave infrared (SWIR), mid wave infrared (MWIR), or long wave infrared (LWIR).

4. The system for swarm navigation using a follow the forward approach according to claim 1, wherein the SAL seeker and the communications link are of different wavelength ranges whereas the SAL is one wavelength range and the communications link is another requiring a second receiver for the communications link.

5. The system for swarm navigation using a follow the forward approach according to claim 1, further comprising an altimeter per round to provide altitude to aid in navigation of the round.

6. A computer-readable medium including contents that are configured to cause a computing system to sort data by performing a method for swarm navigation using a follow the forward approach, comprising:

guiding, via a laser designator, a forward round in a plurality of rounds launched from a launch platform toward a target area; wherein each round comprises:

a semi-active laser (SAL) seeker, wherein the seeker is configured to provide angular bearing of a designator spot location within a target area; provide angular bearings for any forward rounds; and provide an optical communications link via a receiver;

an imager, wherein the imager is configured to locate and identify a plurality of targets in the target area; or provide image-based navigation when correlated with the designator spot location; and an on-board processor, wherein the on-board processor is configured to decode optical messaging from the communications link; correlate the designator laser spot with imagery captured by the imager; generate a target data set; select a target from any currently un-selected targets within the target data set; plot a trajectory for navigation to the selected target using any forward rounds as an airborne constellation; and broadcast, via the optical communications link, the target data set, one or more data sets from forward rounds, and a "self-data" set in order to sustain a cascade;

determining a horizon for providing roll stability and finding up and down using the imager;

detecting via the forward round's imager a target set when the target set is within a field of view (FOV) of the imager;

characterizing the target set, the target set data comprising dispersion geometry for a plurality of targets, a target count, and target IDs;

determining velocity and headings for the plurality of rounds relative to a launch vector;

estimating a range to target for each of the plurality of targets from the launch platform;

selecting a target from un-selected targets in the target set based its range to go and its control authority for the list of un-selected targets;

generating a navigation solution for the round using scene data from the imager; and broadcasting an updated target data set via an optical link to any following rounds.

7. The method for swarm navigation using a follow the forward approach according to claim 6, wherein designation of a target is an actual target or a terrain reference.

8. The method for swarm navigation using a follow the forward approach according to claim 6, wherein the communications link is a pulse repetition interval (PRI) modulated code or standard binary code.

9. The method for swarm navigation using a follow the forward approach according to claim 6, wherein the seeker and the optical communications link receiver are the same device or decoupled into separate components.

10. The method for swarm navigation using a follow the forward approach according to claim 6, wherein a cascade of information is received by the launch platform to establish a quality metric for a target attack.

11. A plurality of rounds configured to operate using a follow the forward approach, the rounds comprising:

a forward looking seeker configured to process designator reflections of a target if the round is a leading round;

a forward facing imager configured to process image scenes of a target area proximate the target if the round is the leading round;

a processing section for determining attributes of the target and one or more additional targets in the target area; and a rearward facing laser for communicating the attributes to subsequent rounds to provide for operation as a constellation.

12. The plurality of rounds according to claim 11, wherein the imagers can be visible (VIS), near infrared (NIR), short wave infrared (SWIR), mid wave infrared (MWIR), or long wave infrared (LWIR).

13. The plurality of rounds according to claim 11, wherein a communications link for communicating can be visible (VIS), near infrared (NIR), short wave infrared (SWIR), mid wave infrared (MWIR), or long wave infrared (LWIR).

14. The plurality of rounds according to claim 11, wherein designation of a target is an actual target or a terrain reference.

15. The plurality of rounds according to claim 13, wherein the communications link is a pulse repetition interval (PRI) modulated code or standard binary code.

16. The plurality of rounds according to claim 13, wherein the seeker and the communications link receiver are the same device or decoupled into separate components.

17. The plurality of rounds according to claim 11, wherein a cascade of information is received by the launch platform to establish a quality metric for a target attack.

18. The plurality of rounds according to claim 11, wherein the SAL seeker and the communications link are of different wavelength ranges whereas the SAL is one wavelength range and the communications link is another requiring a second receiver for the communications link.

19. The plurality of rounds according to claim 11, further comprising an altimeter to provide altitude to aid in navigation of the round.

* * * * *